US006510697B2

(12) United States Patent
Buonpane et al.

(10) Patent No.: US 6,510,697 B2
(45) Date of Patent: Jan. 28, 2003

(54) SYSTEM AND METHOD FOR RECOVERING FROM A POWER FAILURE IN A CRYOPUMP

(75) Inventors: Maureen C. Buonpane, Mansfield, MA (US); Philip D. Acomb, San Ramon, CA (US); Brian D. Foley, Mansfield, MA (US); Michael J. Eacobacci, Jr., South Attleboro, MA (US); Stephen J. Yamartino, Wayland, MA (US); Robert M. Patterson, Burlington, MA (US)

(73) Assignee: Helix Technology Corporation, Mansfield, MA (US)

( * ) Notice: Subject to any disclaimer, the term of this patent is extended or adjusted under 35 U.S.C. 154(b) by 0 days.

(21) Appl. No.: 09/878,160

(22) Filed: Jun. 7, 2001

(65) Prior Publication Data

US 2002/0184896 A1 Dec. 12, 2002

(51) Int. Cl.[7] ..... B01D 8/00
(52) U.S. Cl. ..... 62/55.5; 417/901
(58) Field of Search ..... 62/55.5; 417/901

(56) References Cited

U.S. PATENT DOCUMENTS

| | | | | |
|---|---|---|---|---|
| 4,918,930 | A | 4/1990 | Gaudet et al. | 62/55.5 |
| 5,157,928 | A | 10/1992 | Gaudet et al. | 62/55.5 |
| 5,261,244 | A | 11/1993 | Lessard et al. | 62/55.5 |
| 5,343,708 | A | 9/1994 | Gaudet et al. | 62/55.5 |
| 5,375,424 | A | 12/1994 | Bartlett et al. | 62/55.5 |
| 5,443,368 | A | 8/1995 | Weeks et al. | 417/27 |
| 5,450,316 | A | 9/1995 | Gaudet et al. | 364/184 |
| 5,483,803 | A | 1/1996 | Matté et al. | 62/55.5 |
| 5,775,109 | A | 7/1998 | Eacobacci, Jr. et al. | 62/6 |
| 5,819,545 | A | 10/1998 | Eacobacci, Jr. et al. | 62/55.5 |
| 5,862,671 | A | 1/1999 | Lessard et al. | 62/55.5 |
| 6,022,195 | A | 2/2000 | Gaudet et al. | 417/27 |

*Primary Examiner*—Ronald Capossela
(74) *Attorney, Agent, or Firm*—Hamilton, Brook, Smith & Reynolds, P.C.

(57) ABSTRACT

In a power failure recovery, the operating state before a power failure and present conditions of a cryopump are determined to initiate a regeneration or startup process. Where the refrigerator was operating before power failure, it is turned on during recovery to condense gases in the cryopump. A startup process is initiated where the cryopump was in a startup process before the power failure and present conditions of the cryopump indicate that the cryopump is sufficiently empty or clean. If the operating state and present conditions indicate that a corrosive or hazardous liquid remains in the cryopump, a regeneration process is initiated. If the cryopump was in a shutdown process before the power failure, the cryopanel of the cryopump is refrigerated to a temperature at which gases sublimate from the cryopanel. The temperature of the cryopanel is then maintained until the gases are removed. A refrigerator having a displacer with variable speed and heaters may be used to control the temperature of the cryopanel. When the cryopump is sufficiently empty, the cryopump is turned off.

50 Claims, 3 Drawing Sheets

SYSTEM AND METHOD FOR RECOVERING FROM A POWER FAILURE IN A CRYOPUMP

BACKGROUND OF THE INVENTION

Cryopumps create exceptionally-low-pressure vacuum conditions by condensing or adsorbing gas molecules onto cryopanels cooled by cryogenic refrigerators. Commonly, a cryopump used in this context is cooled by a refrigerator performing a Gifford-McMahon cooling cycle. These refrigerators generally include one or two stages, depending upon which gases are sought to be removed from the controlled atmosphere. Two-stage cryopumps are used when removal of low-condensing-temperature gases, such as nitrogen, argon and hydrogen is desired. The second stage is typically operated at approximately 15 to 20 K to condense these gases upon a cryopanel thermally coupled to the second stage of the refrigerator.

In contrast, a single-stage cryopump, sometimes termed a waterpump, is typically operated at warmer temperatures than the second stage of a two-stage cryopump, typically at about 107 K. Operating at this temperature, a single-stage cryopump will nearly eliminate the presence of water vapor.

In the refrigerator of a typical cryopump, the flow of compressed-gas refrigerant is cyclic. A compressor supplies compressed gas to the refrigerator through a supply line leading to an inlet valve. An exhaust valve leading to an exhaust line returns the refrigerant from the refrigerator to the low-pressure inlet of the compressor. Both valves are located at the first end of a cylinder within the refrigerator. At the opposite, second end of the cylinder, a thermal load, including a cryopanel, is thermally coupled to the cylinder.

With a displacer, including a regenerative heat exchange matrix (regenerator), at a second end of the cylinder, and with the exhaust valve closed and the inlet valve open, the cylinder fills with compressed gas. With the inlet valve still open, the displacer moves to the first end to force compressed gas through the regenerator, the gas being cooled as it passes through the regenerator. The inlet valve is then closed and the exhaust valve is opened, and the gas expands into the low-pressure exhaust line and cools further. The resulting temperature gradient across the cylinder wall at the second end causes heat to flow from the thermal load to the gas within the cylinder. With the exhaust valve opened and the inlet valve closed, the displacer is then moved to the second end, displacing gas back through the regenerator which returns heat to the cold gas, thus cooling the regenerator and completing the cycle.

As layers of condensed gases accumulate upon the cryopanel, the effectiveness of the cryopump is gradually compromised, and the volume of available pumping space may be depleted. To remedy this loss, both single-stage and two-stage cryopumps are routinely subjected to regeneration procedures. During a typical regeneration procedure, the cryopanel, which is coated with a layer of condensed gases, is warmed well above its operating temperature to sublimate or to liquefy and evaporate the gases condensed upon it. The liberated gases are typically removed from the surrounding vacuum chamber by a rough pump, and the cryopanel is returned to its cold, operating temperature. The regeneration procedure thereby cleans the surface of the cryopanel of accumulated condensates.

A selective sublimation regeneration procedure is performed where a toxic or acid forming gas such as chlorine is condensed on a cryopanel. The selective sublimation regeneration procedure releases and removes the toxic or acid forming gas to limit the accumulation of the toxic gas upon the cryopanel and the interaction between the toxic gas and water vapor. The toxic or acid-forming gas is selectively removed from a cryopanel by warming the cryopanel to a temperature within a selective defrost range. At temperatures within this selective defrost range, the toxic or acid-forming gas selectively releases from the cryopanel as a vapor while water remains substantially condensed upon the cryopanel. The temperature of the cryopanel is maintained within this range until the toxic or acid-forming gas is substantially released from the cryopanel and removed from the surrounding chamber. The range of selective defrost temperatures at which the cryopanel is maintained is below the triple point of the electively removed gas so that it is released as a gas and not liquid.

During a typical shutdown procedure of a cryopump, the refrigerator is turned off and heaters are turned on to warm the cryopump to room temperature. Then, the cryopump is turned off. In semiconductor etching processes, where toxic or acid forming gases are routinely used, the shutdown procedure melts the condensed gases on the cryopanel and forms a liquid that may be hazardous or corrosive. A selective regeneration procedure may be performed before shutdown to sublimate toxic or acid forming gases prior to turning off the cryopump to avoid the melting of condensed gases and subsequent formation of a hazardous liquid. After the regeneration cycle is completed but before the cryopanel is cooled back down to operating temperature, the cryopump is turned off.

In the event of a power failure, a cryopump may be set to follow a power failure recovery procedure after power recovers, such as disclosed in U.S. Pat. No. 5,157,928. The system first determines whether the cryopump was on, off or in regeneration when the power went out. If the cryopump was off, then the cryopump remains off. If the pump was on, then the system checks to determine whether the sensed temperature is sufficiently low to permit a successful restart of the cryopump and, if so, to start the refrigerator motor. If the temperature is above a set point temperature, the system initiates a regeneration cycle. If the cryopump was in regeneration, the system determines whether the cryopump was in the process of cooling down. If the cryopump was not cooling down, regeneration is restarted. If the cryopump was cooling down, the system determines whether the sensed pressure is sufficiently low to continue the original regeneration cycle and, if so, cool down is continued. If the sensed pressure is not sufficiently low, regeneration is restarted.

In a system having a sublimation regeneration mode, the power failure recovery procedure may be different. In particular, different steps may be followed where the cryopump was in regeneration or cryopump on. Unlike the power failure recovery procedure of non-sublimation regeneration systems, if the cryopump was in regeneration, the system further determines whether the cryopump was in the process of sublimating. If the cryopump was sublimating, the system determines whether the sensed temperature is above or below a set point temperature. If the temperature is above the set point, the cryopump remains off. If the cryopump was not sublimating, the system then determines whether the cryopump was cooling down. The system also determines whether the cryopump was cooling down where the cryopump was sublimating but the sensed temperature is below the set point. If the cryopump was cooling down, the system continues the cool down process without checking pressure. If the cryopump was not cooling down, regeneration is restarted as before. As in the non-sublimation recovery, if the cryopump was on and the system determines that the sensed temperature is below a set point temperature, then the cryopump is turned on. However, if the sensed temperature is above the set point, the system determines whether the recovery procedure or cool down is to be followed as preset by the user. If the recovery procedure was selected, then the cryopump is turned on. If the cool down process was selected, then the cryopump remains off.

SUMMARY OF THE INVENTION

A power failure recovery, regeneration or shutdown may cause damage to the system and may present health risks if performed improperly. A toxic or acid forming gas, such as chlorine gas ($Cl_2$), is routinely used in semiconductor etching processes which commonly incorporate the use of a cryopump. When toxic gas is present in a chamber of a process tool where the cryopump is operating, the toxic gas typically condenses upon the cryopanel along with condensed water.

In the event of a power failure, regeneration or shutdown, toxic or acid forming gases are liberated. The liberated gases routinely intermix and react with one another to form corrosive and hazardous liquid. For example, chlorine reacts with water to produce hydrochloric acid. Hydrochloric acid is highly corrosive, and, therefore, may damage the chamber, the work pieces within it, and the cryopump. Moreover, the production of hydrochloric acid creates disposal problems as well as a health hazard for individuals in contact with the process tool. If left to accumulate unabatedly, a dangerous amount of corrosive or hazardous liquid can be left in the chamber after the refrigerator has warmed, or in the event of a power failure.

Typical power failure recovery procedures fail to remove or limit the accumulation of gases and liquid remaining after a power failure. To sufficiently remove liquid, a sublimation regeneration process should be followed. Since the power recovery procedures typically perform a non-sublimation regeneration, gases and liquid remain in the cryopump after the power recovery is completed.

In a system having a sublimation regeneration mode, the power recovery procedure also may fail to sufficiently remove or limit the accumulation of gases and liquid remaining after the power failure. For example, a liquid formed during a power outage remains in the cryopump where the cryopump was in regeneration before the power failure but stays off because it is determined that the cryopump was sublimating and the sensed temperature is above the set point. Similarly, the recovery procedure fails to remove liquid where the cryopump was on before the power failure but stays off after power recovery because the sensed temperature is above the set point and the user selected the cool down. Further, both recovery procedures fail to provide a recovery process where the cryopump was in a shutdown process before the power failure.

The risks presented by corrosive and hazardous liquids can be minimized by limiting the accumulation of liquid and removing the liquid during a recovery from a power failure by always turning the refrigerator back on during recovery. In accordance with one aspect of the invention, when power recovers after a power failure, the operating state of the cryopump before the power failure and present conditions of the cryopump are determined. More specifically, depending on the operating and present conditions of the cryopump, a regeneration or startup process is initiated.

The regeneration process is initiated where there may be an accumulation of corrosive or hazardous liquid or toxic forming gases remaining in the cryopump. For example, if the cryopump was on before the power failure but the present temperature of the cryopump is above a set point temperature, then the regeneration process is initiated to remove any gases or liquid from the cryopump. The set point temperature may be between 110 and 260 K. The regeneration process is also initiated where the cryopump was in a regeneration cycle before the power failure but the present pressure of the cryopump is above a predetermined pressure level.

Regenerations are used to sublimate toxic or acid forming gases from the cryopump. The regeneration process includes refrigerating the cryopanel to a temperature within a defrost range and maintaining the temperature until the gases are removed from the cryopump. The range of defrost temperatures at which the cryopanel is maintained is below the triple point of the gases being removed. The defrost temperature may be set at about or less than 250 K. The gases are substantially removed and the cryopump is clean when the pressure of the cryopump drops to the predetermined pressure level. The set point pressure level may be about 100 microns. After the removal of condensed gases, the cryopanel may be cooled down to the operating, cryogenic temperature.

If the cryopump was in a shutdown procedure before the power failure, then a regeneration cycle may be initiated. After the regeneration cycle, the cryopump may be warmed to about 310 K. The cryopump is then turned off.

The startup process includes cooling down the cryopump to the operating temperature. The startup process is initiated where the cryopump was in a startup process before the power failure. The startup process is also initiated where the cryopump was on before the power failure and the present temperature of the cryopump is below the set point temperature. If the cryopump was in a regeneration process before the power failure and the present pressure of the cryopump is below the predetermined pressure level then the startup process is initiated when power recovers.

The cryopump may be cooled by a single stage refrigerator performing a Gifford-McMahon cooling cycle. The temperature at which the cryopanel is maintained during operation may be between 50 and 150 K.

A shutdown procedure may include a regeneration cycle to prevent the accumulation of corrosive or hazardous liquid in the cryopump.

An electronic module may be programmed to determine the operating state before a power failure and present conditions of a cryopump and initiate a regeneration or startup process depending on the operating state and present conditions of the cryopump.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Cryopumps are often used in applications where ambient gases include those that are inherently either hazardous or reactive with other condensed gases to form hazardous products. For example, cryopumps are routinely used in the fabrication of electronic devices, microelectronics, flat panel displays, and magnetic media. Each of these processes may necessitate the use of a dry etch process performed in vacuum pressure regimes of 50 to 200 mtorr. Often, chlorine, boron trichloride ($BCl_3$) and hydrogen bromide (HBr) are used to etch the processed articles.

Figure 1:
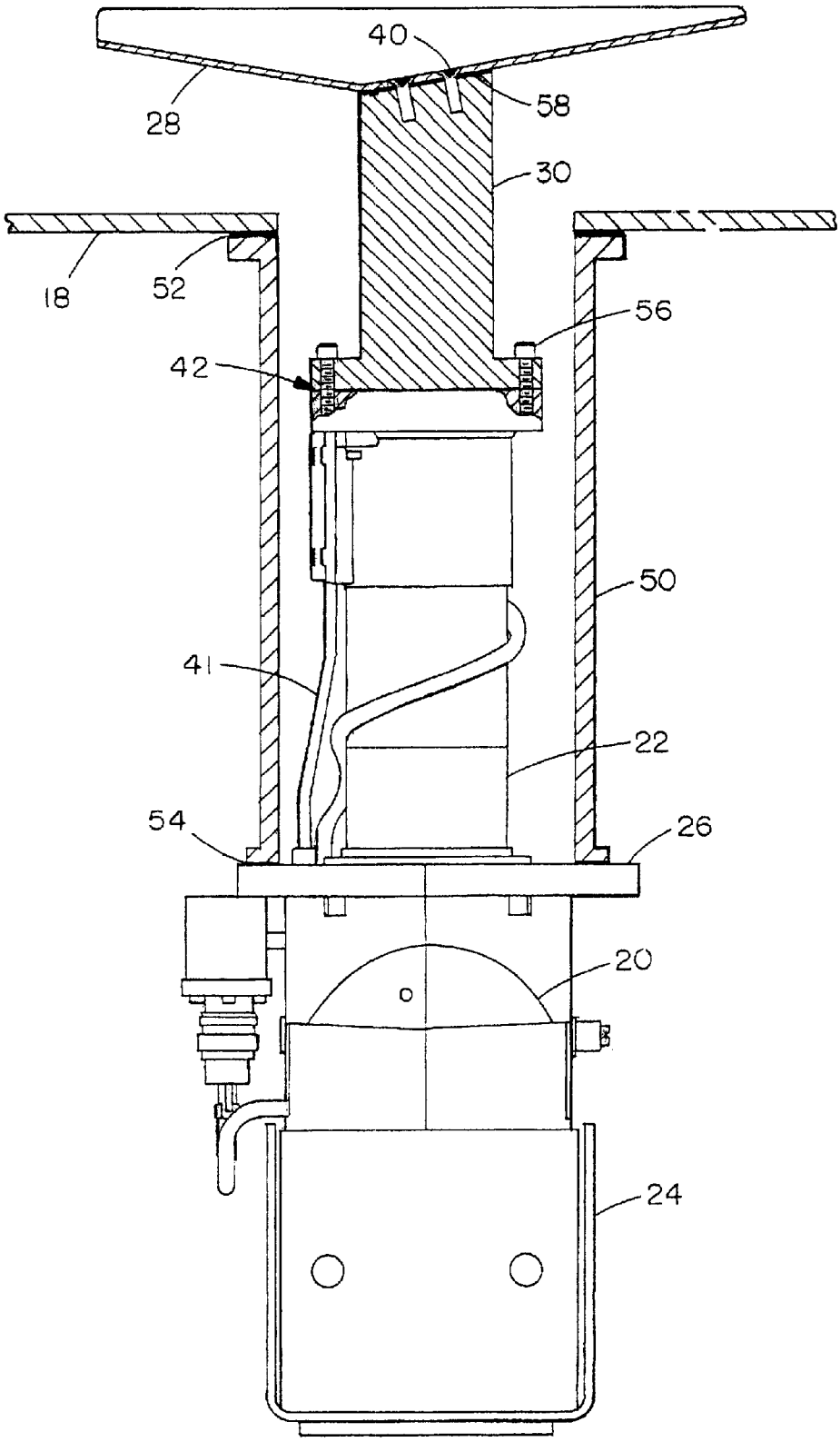
FIG. 1 illustrates a side view, partially in cross section of a single-stage cryopump.

A single-stage cryopump suitable for semiconductor manufacturing processes is illustrated in FIG. 1. The cryopump is mounted to the walls 50 of a coupling vessel through a flange 26. The coupling vessel walls 50, in turn, are mounted to a wall 18 of a vacuum chamber. The cryopump thereby projects into the vacuum chamber, which may be a load lock or a transfer chamber, at a cold finger 22 or at a thermally-conductive post 30 of the cryopump. The thermally-conductive post 30 preferably comprises copper or aluminum. The thermally-conductive post 30 is mounted to the cold finger 22 with bolts 56 and with an indium sheet 42 forming an interface between the post 30 and the cold finger 22. A cryopanel 28 is similarly mounted to the thermally-conductive post 30, with a second indium sheet 58 likewise positioned between the mounted surfaces. A heater 41 is controlled by an electronic module 24 to warm the cryopanel 28 to reach or maintain a desired temperature.

The air-tight integrity of the chamber across the interfaces of the vacuum chamber wall 18, coupling vessel walls 50 and cryopump is maintained by seals positioned at the junctures of each of these elements. A first seal is provided by an O-ring 52 placed between the coupling vessel walls 50 and the vacuum chamber wall 18. At the opposite ends of the walls 50 of the coupling vessel, another seal 54 is placed between the coupling vessel 50 and the flange 26.

To prevent corrosion of the cryopanel when toxic gases, such as chlorine and hydrogen bromide, are condensed, the cryopanel is preferably coated with a corrosion-resistant polymer. Aluminum is preferably used as the underlying material of the cryopanel. Preferably, the polymer coating applied to the aluminum is a halogenated or perhalogenated alkenyl or alkoxy polymer of $C_1$ to $C_4$ repeat units, including copolymers thereof, wherein the repeat units are substantially halogenated with fluorine, chlorine or combinations thereof.

Figure 2:
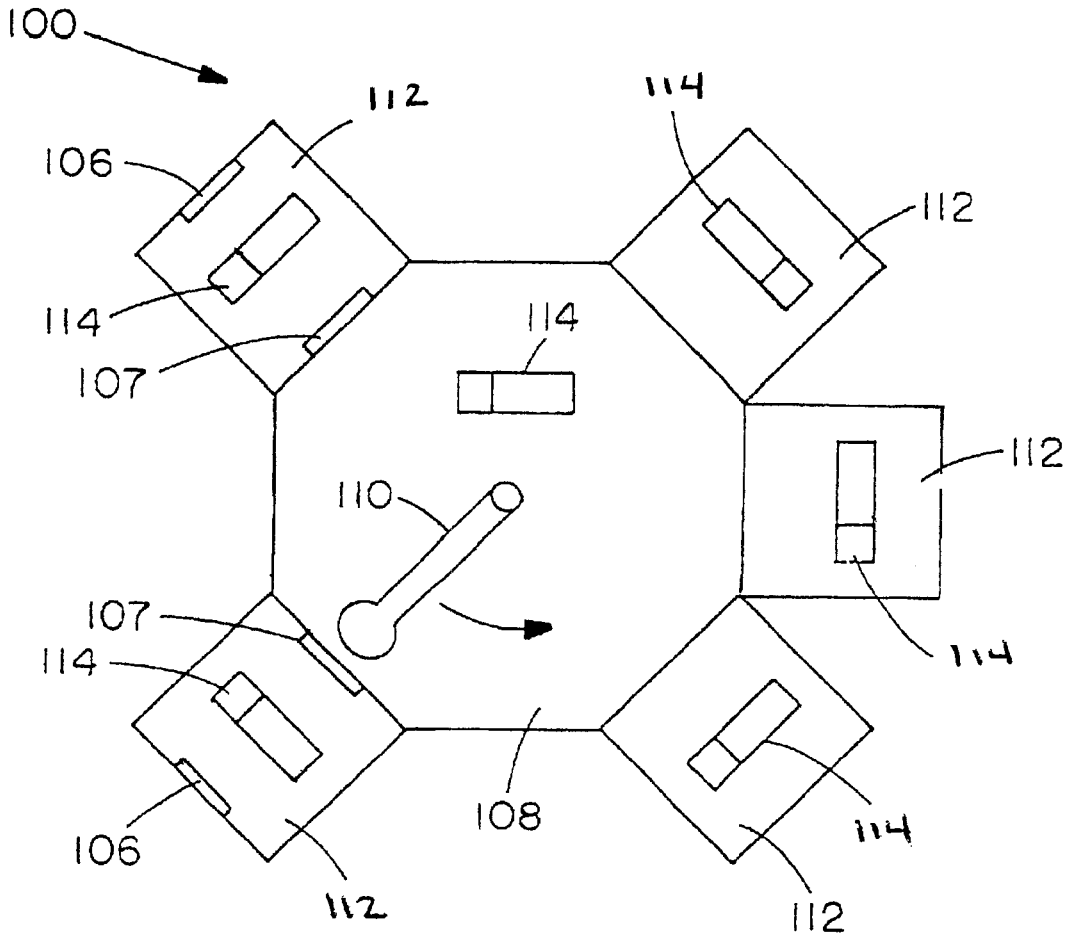
FIG. 2 is a cross-sectional overhead view of a cluster process tool.

A cluster process tool suitable for dry etching and other semiconductor manufacturing processes is illustrated in FIG. 2. The process tool 100 typically includes a plurality of interconnected chambers including an entrance load lock 102, an exit load lock 104, and process chambers 112. Each of the vacuum-isolated load locks 102 and 104 includes a cryopump 114 and a pair of slidable doors 106 and 107. An exterior door 106 opens to the outside atmosphere, and an interior door 107 opens to a transfer chamber 108 which serves as the hub of the process tool 100. Process chambers 112, where manufacturing processes such as etching are performed, open to the transfer chamber 108 along its periphery. Within the transfer chamber 108, a robotic arm 110 rotates to transfer elements among the chambers. The necessary vacuum within the transfer chamber 108 and process chambers 112 is maintained by cryopumps 114 placed within each of the chambers. In the manufacture of semiconductors, the transfer chamber 108 is typically operated in a pressure range of 107 torr to 400 mtorr.

The cryopump within each of the load locks 102 and 104 of the cluster process tool is typically operated at 50 to 150 K, and the pressure within the locks 102 and 104 may be as high as one torr. Because of the comparatively high pressure within the locks 102 and 104, the locks 102 and 104 can accommodate a much higher vapor pressure of gases as compared to the transfer chamber 108. As a result, cryopanels 114 in the load locks 102 and 104 can be operated at temperatures higher than that of the cryopanel 114 in the transfer chamber 108. Cryopanels 114 remain sufficiently cold to maintain a low background water vapor pressure in the locks.

In a typical operation of the process tool 100, the exterior door 106 of the entrance load lock 102 opens. While the exterior door 106 is open, semiconductor wafers are manually inserted into the lock 102 through the exterior door 106. After the door 106 is resealed, a roughing pump reduces the pressure within the load lock to about $10^{-3}$ torr while a cryopump 114 condenses gases including water, $Cl_2$, HBr and HCl to achieve significantly lower pressures. The dual action of these pumps thereby reestablishes vacuum conditions within the load lock 102.

Once the pressure within the entrance load lock 102 has returned to a sufficiently low level, the interior door 107 opens, and the rotating arm 110 removes the wafers from the load lock 102 and sequentially delivers the wafers to, and retrieves them from, each of the processing chambers 112. Notwithstanding the operation of a cryopump 114 within the transfer chamber 108, some of the gas remains in its vapor phase and migrates through the chambers. Accordingly, when the interior door 107 to the entrance load lock 102 is opened, low levels of gas vapors typically migrate to the load lock 102 where they condense and gradually accumulate upon the cryopanel 114. If, at any time, the pump ceases operation or malfunctions, the condensed gases will sublimate from the cryopanel 114. If the cryopump warms sufficiently, the condensed gases will melt through to a liquid phase.

When a cryopump is regenerated, or when power is lost or the cryopump malfunctions or shuts down, liberated gases routinely intermix and react with one another, including water. Water vapor is typically a significant constituent of ambient air. Accordingly, water condensate, i.e., ice, is commonly found on cryopanel surfaces. Chlorine reacts readily with water to produce hydrochloric acid. If formed within the surrounding chamber, hydrochloric acid is difficult to manage and will typically corrode the chamber interior as well as the exhaust equipment. Hydrochloric acid also presents a serious health hazard to anyone reaching into the chamber or sufficiently proximate to the chamber to inhale vapors released therefrom. Like chlorine, fluorine presents a respiratory hazard and may react with water to form a corrosive acid, i.e., hydrofluoric acid.

Further, when a cryopump is regenerated, or when power is lost or the cryopump malfunctions or shuts down, gases gradually sublimate from the cryopanel as the temperature of the cryopanel increases because the vapor pressure of gases generally rises with increasing temperature. However, if the vapor pressure is sufficient, condensed gases will melt to form a liquid at temperatures greater than the triple point temperature. The formation of a liquid phase should be avoided, however, because it is more difficult to remove from the cryopump. In addition, as described above, if a hazardous liquid is present in the cryopump, it may cause damage to the system and personal harm, especially after a shutdown procedure.

Pressure-based regenerations may be performed over the course of operating a process tool. The pressure-based regeneration provides a full regeneration of the cryopump by removing gases until a predetermined pressure level is reached, producing clean cryopanel surface. In a regeneration cycle, the heater 41 is activated and the cryopanel is warmed from its operating temperature to about 230 K. The refrigerator of the cryopump may have a displacer (not shown) with variable speed, in which case the cryopanel may be warmed by slowing the reciprocating motion of the displacer. The temperature on the cryopanel may be controlled by using a combination of heaters and a refrigerator having a displacer with variable speed. Nearly all gases are thereby sublimated from the cryopanel. The formation of liquid-phase gas is prevented by maintaining the temperature of the cryopanel below the triple point of the gases being removed. The released gases are removed, in its vapor phase, from the surrounding process chamber by a roughing pump, typically a mechanical vacuum pump. The released gases are removed until the pressure drops to a predetermined pressure level. The pressure reduction to the predetermined pressure level indicates that the cryopump is sufficiently empty or clean. After the gas has been substantially released from the cryopanel and removed from the chamber, the cryopanel is recooled to its operating temperature between 50 K and 150 K. The cryopanel resumes its normal pumping operation at the operating temperature.

The regeneration procedure may be performed according to U.S. Pat. No. 5,819,545 issued to Eacobacci, Jr. et al. and assigned to Helix Technology Corporation, the assignee of the present application, which application is hereby incorporated by reference in its entirety.

Figure 3:
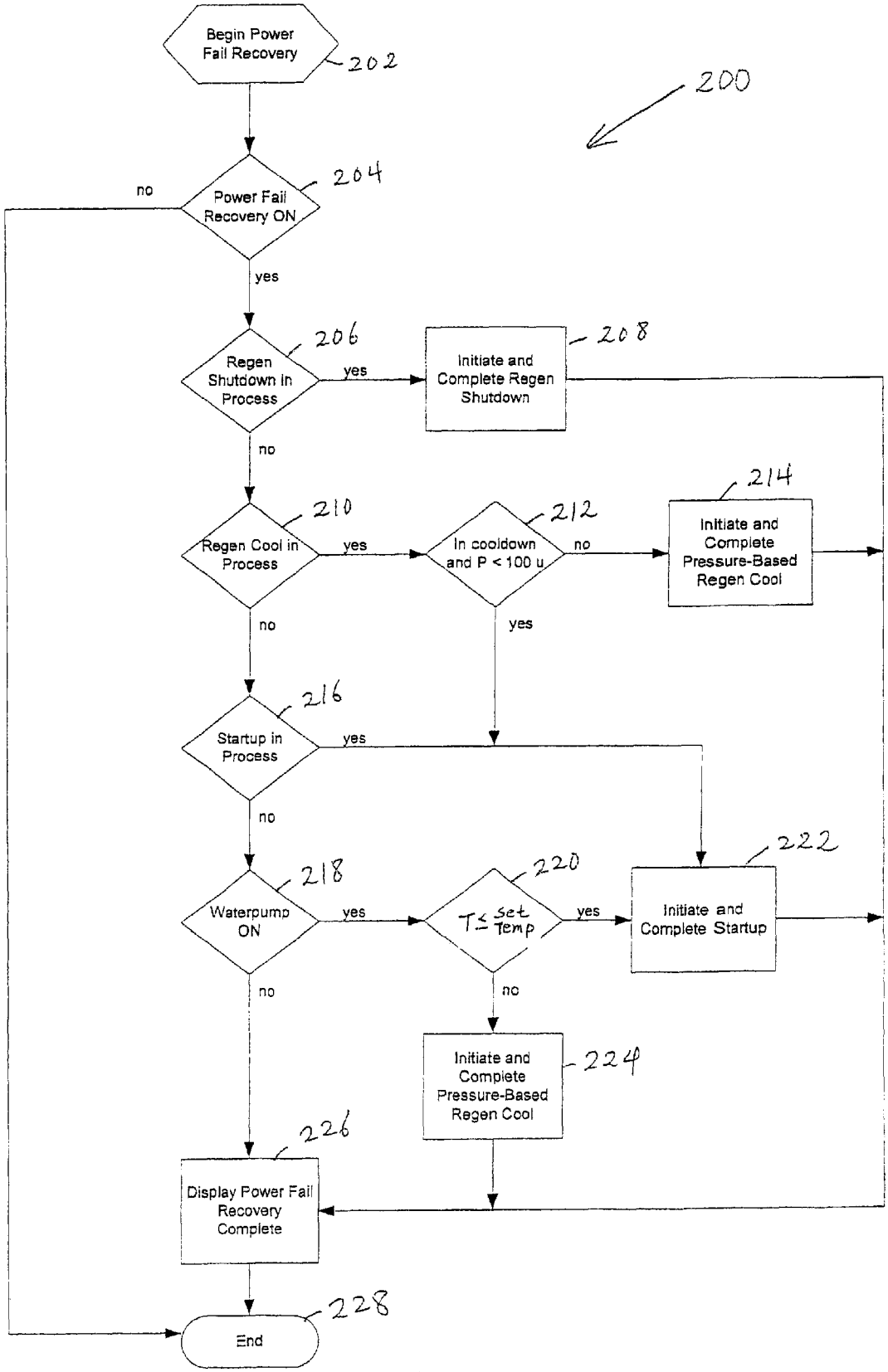
FIG. 3 is a flow chart of a power failure recovery procedure.

FIG. 3 is a flow chart of a power failure recovery procedure 200. The power failure recovery procedure prevents the accumulation of corrosive or hazardous liquid that can result after a regeneration, power failure or cryopump malfunctions. The electronic module 24 is programmed to control the power failure recovery procedure. After power recovers, the power failure recovery 200 is started, as indicated at 202. The system checks at 204 to determine whether the recovery procedure 200 is to be followed as preset by the user. If not, the cryopump stays off and the recovery procedure ends, as indicated at 228. If the recovery procedure 200 is to be followed, the system determines the operating state of the cryopump before a power failure. At 206, the system determines whether the cryopump was in a shutdown process when the power went out.

If the operating state of the cryopump before the power failure was a shutdown, the system initiates at 208 a shutdown process. The system initiates and completes the regeneration process to ensure that the cryopump is empty and clean when it is turned off. The regeneration process includes refrigerating or warming the cryopanel to a temperature at which gases sublimate. The released gases are removed by rough pumping the cryopump. The roughing pump is generally a mechanical vacuum pump mounted to the cryopump. The temperature is maintained until the gases are substantially removed. The temperature may be about 230 K. Since the cryopump will be turned off and not in use, the system does not cool down the cryopanel after the regeneration process. Instead, after the regeneration process, the cryopump may be turned off. The display at 226 indicates that the recovery procedure 200 is completed.

If the operating state before the power failure was not a shutdown, the system checks at 210 whether the cryopump was in a regeneration process. If it is determined that the operating state of the cryopump before the power failure was a regeneration, the system determines at 212 whether the pressure of the cryopump is below a predetermined pressure level, such as 100 microns. The predetermined pressure may be in the range of 50 to 150 microns. If liquid or solid remains on the cryopanel or pooled anywhere in the cryopump, the pressure will hang up at a pressure plateau. The level of that plateau depends on the fluid involved. However, the one hundred micron level is below any plateau that would be experienced and should be reached if the cryopump is sufficiently empty or clean of gases and liquid.

If at 212 the pressure is below 100 microns and pump is in "cool down," it is determined that the cryopump is sufficiently empty and a startup process is initiated at 222 to start operating the cryopump. Then, the display at 226 indicates that the recovery procedure 200 is completed. If the pressure is not less than 100 microns, indicating that the cryopump is not sufficiently empty, a regeneration is initiated and completed at 214. This process is the same as that at 208 except that, after completion, the cryopump is cooled to operating temperature; that is, it follows the normal regeneration process described above.

If at 210 the operating state was not a regeneration, the system checks at 216 whether the cryopump was in a startup process. Since the cryopump is sufficiently empty and clean after a shutdown process and until the next operation, the cryopump is clean at the startup process. So, if operating state was a startup then the startup process is initiated and completed at 222; that is, the cryopump is cooled to operating temperature. The display at 226 then indicates that the recovery procedure 200 is completed.

If at 216 the system was not in startup, the system determines at 218 whether the cryopump was on. If the cryopump was on, the system checks at 220 whether the temperature of the cryopanel is above or below a set point temperature, such as 230 K. The set point temperature may be between 110 K and 260 K. The set point temperature depends on the temperature of the triple point of gases involved to ensure that there is no liquefaction of gases and the accumulation of the liquid-phase gases during the power failure. If the temperature is below the set point, it is determined that the cryopump temperature is cool enough to continue operating the cryopump. The startup process is initiated and completed at 222, where the display at 226 indicates that the system has recovered after power failure. If temperature is above the set point temperature, liquid or solid may remain on the cryopanel or pooled somewhere in the cryopump. So, a regeneration process is initiated and completed at 224, like that at 214. Upon completion of regeneration and cool down, the display at 226 indicates that the recovery procedure 200 is completed.

If the system determines at 218 that the cryopump was off, the cryopump remains off. The display 226 indicates that the recovery procedure 200 is completed.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for recovering from a power failure in a cryopump having a refrigerator comprising:

determining operating state of the cryopump before the power failure; and in all cases where the refrigerator was operating prior to the power failure, turning on the refrigerator to condense gases in the cryopump.

2. The method of claim 1 further comprising initiating a regeneration or startup process depending on the operating state and present conditions.

3. The method of claim 1 wherein operating states include regeneration, startup, shutdown, cryopump on, and cryopump off.

4. The method of claim 1 wherein a regeneration process is initiated where the operating state is shutdown.

5. The method of claim 4 further comprising turning off the cryopump.

6. The method of claim 1 wherein a startup process is initiated where the operating state is startup.

7. The method of claim 1 further comprising, if the operating state is regeneration, determining the pressure of the cryopump.

8. The method of claim 7 wherein a startup process is initiated where the pressure is below a predetermined pressure level.

9. The method of claim 7 wherein a regeneration process is initiated where the pressure is above a predetermined pressure level.

10. The method of claim 1 further comprising, if the operating state is cryopump pump on, determining the temperature of the cryopump.

11. The method of claim 10 wherein a startup process is initiated where the temperature is below a set point temperature.

12. The method of claim 10 wherein a regeneration process is initiated where the temperature is above a set point temperature.

13. The method of claim 1 further comprising keeping cryopump off where the operating state is cryopump off.

14. The method of claim 2 wherein the regeneration process includes refrigerating the cryopump to a temperature within a defrost range at which gases sublimate from the cryopump, and maintaining the temperature of the cryopump within the defrost range until the gases are substantially removed from the cryopump.

15. The method of claim 14 further comprising monitoring pressure of the cryopump to determine that the cryopump is sufficiently clean when the pressure drops to a predetermined pressure level.

16. The method of claim 15 wherein the predetermined pressure level is between about 75 to 100 microns.

17. The method of claim 14 wherein the defrost range is a temperature between about 110 K and 250 K.

18. The method of claim 1 wherein the cryopump evacuates a work chamber in an etch application.

19. The method of claim 1 wherein the refrigerator performs a Gifford-McMahon cooling cycle.

20. The method of claim 1 wherein the refrigerator is a single-stage refrigerator.

21. The method of claim 1 wherein the refrigerator has a displacer with variable speed to control temperature.

22. A cryopump comprising:

a refrigerator; and electronics programmed to, after a power failure, determine operating state of the cryopump before the power failure, and in all cases where the refrigerator was operating prior to the power failure, turn on the refrigerator to condense gases in the cryopump.

23. The cryopump of claim 22 wherein the electronics are further programmed to initiate a regeneration or startup process depending on the operating state and present conditions.

24. The cryopump of claim 22 wherein the electronics are further programmed to control temperature of the refrigerator by adjusting the speed of a displacer.

25. A method for shutting down a cryopump having a refrigerator in a power recovery comprising:

refrigerating the cryopump to a temperature within a defrost range at which gases sublimate from the cryopump;

maintaining the temperature of the cryopump within the defrost range until the gases are substantially removed from the cryopump; and turning off the cryopump.

26. The method of claim 25 wherein refrigerating the cryopump to a temperature is controlled by adjusting the speed of a displacer in the refrigerator.

27. A cryopump comprising:

a refrigerator; and electronics for shutting down the cryopump after a power failure, the electronics being programmed to refrigerate the cryopump to a temperature within a defrost range at which gases sublimate from the cryopump, and maintain the temperature of the cryopump within the defrost range until the gases are substantially removed from the cryopump.

28. The cryopump of claim 27 wherein the electronics are further programmed to turn off the cryopump.

29. The cryopump of claim 27 wherein the electronics are further programmed to control temperature of the refrigerator by adjusting the speed of a displacer.

30. A method for operating a cryopump recovering from a power failure comprising:

determining operating state of the cryopump before the power failure;

determining present conditions of the cryopump; and turning on a refrigerator to initiate a regeneration, startup or shutdown process depending on the operating state and present conditions.

31. The method of claim 30 wherein the shutdown process is initiated where the operating state is shutdown.

32. The method of claim 30 wherein the startup process is initiated where the operating state is startup.

33. The method of claim 30 further comprising, if the operating state is regeneration, determining the pressure of the cryopump.

34. The method of claim 33 wherein the startup process is initiated where the pressure is below a predetermined pressure level.

35. The method of claim 33 wherein the regeneration process is initiated where the pressure is above a predetermined pressure level.

36. The method of claim 30 further comprising, if the operating state is cryopump on, determining the temperature of the cryopump.

37. The method of claim 36 wherein the startup process is initiated where the temperature is below a set point temperature.

38. The method of claim 36 wherein the regeneration process is initiated where the temperature is above a set point temperature.

39. The method of claim 30 further comprising keeping cryopump off where the operating state is cryopump off.

40. A method for operating a cryopump recovering from a power failure comprising:

determining operating state of the cryopump before the power failure;

determining present conditions of the cryopump; and initiating a regeneration, startup or shutdown process depending on the operating state and present conditions, the shutdown process includes refrigerating the cryopump to a temperature within a selective defrost range at which gases sublimate from the cryopump, maintaining the temperature of the cryopump within the selective defrost range until the gases are substantially removed from the cryopump, and turning off the cryopump.

41. The method of claim 40 further comprising, prior to turning off the cryopump, warming the cryopump to about 310 K.

42. The method of claim 40 wherein the shutdown process is initiated where the operating state is shutdown.

43. The method of claim 40 wherein the startup process is initiated where the operating state is startup.

44. The method of claim 40 further comprising, if the operating state is regeneration, determining the pressure of the cryopump.

45. The method of claim 44 wherein the startup process is initiated where the pressure is below a predetermined pressure level.

46. The method of claim 44 wherein the regeneration process is initiated where the pressure is above a predetermined pressure level.

47. The method of claim 40 further comprising, if the operating state is cryopump on, determining the temperature of the cryopump.

48. The method of claim 47 wherein the startup process is initiated where the temperature is below a set point temperature.

49. The method of claim 40 wherein the regeneration process is initiated where the temperature is above a set point temperature.

50. The method of claim 40 further comprising keeping cryopump off where the operating state is cryopump off.

* * * * *